US008651483B2

(12) United States Patent
Albers et al.

(10) Patent No.: US 8,651,483 B2
(45) Date of Patent: Feb. 18, 2014

(54) SHEET INVERTING DEVICE AND METHOD OF INVERTING A FOLDED SHEET

(75) Inventors: Antonius G. H. Albers, Helmond (NL); Henricus A.M. Janssen, Horst (NL); Robertus P.C. Quirijnen, Velden (NL)

(73) Assignee: Oce Technologies B.V., Venlo (NL)

( * ) Notice: Subject to any disclaimer, the term of this patent is extended or adjusted under 35 U.S.C. 154(b) by 0 days.

(21) Appl. No.: 13/477,384

(22) Filed: May 22, 2012

(65) Prior Publication Data

US 2012/0235348 A1 Sep. 20, 2012

Related U.S. Application Data

(63) Continuation of application No. PCT/EP2010/067928, filed on Nov. 22, 2010.

(30) Foreign Application Priority Data

Nov. 23, 2009 (EP) ..... 09176736

(51) Int. Cl.
*B65H 29/00* (2006.01)
*B65H 29/20* (2006.01)

(52) U.S. Cl.
USPC ..... 271/315; 271/186; 271/187

(58) Field of Classification Search
USPC ..... 271/314, 315, 186, 187, 902, 225
See application file for complete search history.

(56) References Cited

U.S. PATENT DOCUMENTS

| | | | | |
|---|---|---|---|---|
| 4,883,265 | A | 11/1989 | Iida et al. | |
| 5,207,412 | A | 5/1993 | Coons, Jr. et al. | |
| 5,350,169 | A | 9/1994 | Hiroi et al. | |
| 6,095,518 | A | 8/2000 | Allmendinger et al. | |
| 6,436,024 | B1 | 8/2002 | Kobayashi | |
| 7,431,288 | B2 * | 10/2008 | Shmaiser et al. | 271/186 |
| 7,549,634 | B2 * | 6/2009 | Choi | 271/187 |
| 7,651,093 | B2 * | 1/2010 | Ko | 271/315 |
| 2005/0242498 | A1 * | 11/2005 | Sato | 271/302 |
| 2007/0108690 | A1 | 5/2007 | Hayashi et al. | |
| 2012/0267845 | A1 * | 10/2012 | Rutten et al. | 271/186 |

FOREIGN PATENT DOCUMENTS

| | | | |
|---|---|---|---|
| DE | 197 22 295 | A1 | 12/1998 |
| JP | 59-127048 | U | 8/1984 |
| JP | 2002-348016 | A | 12/2002 |

* cited by examiner

*Primary Examiner* — Patrick Cicchino
(74) *Attorney, Agent, or Firm* — Birch, Stewart, Kolasch & Birch, LLP

(57) ABSTRACT

A sheet inverting device and a method of inverting a folded sheet include an inverting element that inverts the sheet around an axis of rotation towards a receiving member for receiving the sheet, and at least one moveable stop member that limits, in a first position of the stop member above the receiving member, an unfolding movement of the sheet in a direction towards a far side of the receiving member. The stop member is adapted to be retracted from the first position into a second position of the stop member.

10 Claims, 4 Drawing Sheets

SHEET INVERTING DEVICE AND METHOD OF INVERTING A FOLDED SHEET

CROSS-REFERENCE TO RELATED APPLICATIONS

This application is a Continuation of International Application No. PCT/EP2010/067928, filed on Nov. 22, 2010, and for which priority is claimed under 35 U.S.C. §120, and which claims priority under 35 U.S.C. §119 to Application No. 09176736.8, filed on Nov. 23, 2009 in Europe. The entirety of each of the above-identified applications is expressly incorporated herein by reference.

BACKGROUND OF THE INVENTION

1. Field of the Invention

The present invention relates to inverting a folded sheet that comprises a large panel and a small panel that is folded, at a first edge side of the sheet, against the large panel on a first side of the sheet.

The terms "large panel" and "small panel" are to be understood as referring to the width of the respective panel in a lateral direction, i.e. transverse to the fold line(s) of the sheet. Thus, the small panel is narrower than the large panel. The fold lines define the extension of the panels. The sheet is, for example, a z-folded sheet having two parallel fold lines or, in particular, a sheet having an engineering fold, also known as a fold-out. An engineering fold is an asymmetric z-fold such as schematically shown in FIG. 5. The folded sheet has a large back panel and small center and front panels. In use, the front panel of the folded sheet may be pulled out to expand the sheet to its full width.

2. Background of the Invention

U.S. Pat. No. 5,207,412 describes a document integrator that allows stacking regular sheets as well as z-folded oversize sheets. A folded oversize sheet exits a sheet folder with its folded edge as the leading edge and is conveyed to a sheet inverter disk. The sheet is inserted into a slot of the sheet inverter disk, which then rotates to invert, i.e. flip over, the oversize folded sheet. The sheet is stripped from the inverter disk when the slot containing the folded oversize sheet passes through a stripping wall. The sheet is then conveyed by a vacuum transport belt towards a second sheet inverter disk that places the sheet on a stacker tray. Although the vacuum transport belt holds the inverted sheet thereon, a blower is provided for blowing a stream of air onto the inverted folded oversize sheet from above, so as to further prevent the sheet from unfolding.

The inventors have found that, when inverting a folded sheet using a conventional sheet inverter disk or similar device, the problem may arise that the folded sheet unfolds while rolling out from the sheet inverter disk, if the sheet is fed to the sheet inverter disk with its folded edge as the trailing edge and the small folded panel is the top panel before inverting.

In particular, it has been observed that, while the large panel is rotated and bent by the inverting element, the small panel may assume a straight form, such that the "inner edge" of the folded sheet, i.e. the edge of the small panel that is distant from the outer edges of the folded sheet, separates from the curved large panel. In other words, while the leading edge of the large panel follows the curved contour of the inverting element, because it is accommodated in a slot of the inverting element, the small panel may tangentially protrude from the large panel.

It may then happen that the "inner edge" gets ahead of the trailing edge of the sheet on top of a receiving member for receiving the sheet, such as a stacker tray, for example. Thus, during inverting the sheet, the sheet unfolds. The inventors have found that the described problem is particularly pronounced in the described case of a z-folded sheet comprising a large panel and a small, folded panel, which is to be fed to the inverting device with its folded edge as a trailing edge such that, after inverting the sheet, the folded, small panel is to be positioned below the large panel. However, a similar problem may arise with different sheet configurations and/or orientations.

SUMMARY OF THE INVENTION

It is an object of the present invention to provide a sheet inverting device for inverting a folded sheet that has a higher reliability of keeping the sheet in its folded state, in particular when the sheet is oriented as described above.

According to the present invention, this object is achieved by a sheet inverting device for inverting a folded sheet, comprising: a receiving member for receiving the sheet, an inverting element for inverting the sheet around an axis of rotation towards the receiving member, and at least one moveable stop member for limiting, in a first position of the stop member above the receiving member, an unfolding movement of the sheet in a direction towards a far side of the receiving member, wherein the stop member is adapted to be retracted from the first position into a second position of the stop member. For example, the stop member is retracted towards the far side of the receiving member. In particular, the stop member may be adapted to be retracted from the first position into the second position for enabling a presently inverted sheet to roll out onto the receiving member. The unfolding movement to be prevented is a movement towards the far side of the receiving member.

In particular, for example, the object is achieved by a sheet inverting device for inverting a folded sheet comprising a large panel and a small panel that is folded, at a first edge side of the sheet, against the large panel on a first side of the sheet, the sheet inverting device comprising: a receiving member for receiving the sheet with a second sheet side up, an inverting element for inverting the sheet around an axis of rotation onto the receiving member in a direction such that a second edge of the sheet is received at a near side of the receiving member, and at least one movable stop member for limiting, in a first position of the stop member above the receiving member, an unfolding movement of the small panel of the sheet at the first side of the presently inverted sheet in a direction towards a far side of the receiving member, wherein the stop member is adapted to be retracted from its first position into a second position of the stop member.

For example, the sheet is a sheet having an engineering fold, such as schematically shown in FIG. 5.

For example, the first side of the sheet is a front side of the sheet, and the second side of the sheet is a back side of the sheet. Thus, the sheet is to be placed on the receiving member with its back side up and the large panel above the small panel.

For example, the sheet may be received directly on the receiving member, or on top of one or more sheets that are stacked and/or have been received on the receiving member previously.

The terms "near side of the receiving member" and "far side of the receiving member" are to be understood as describing an orientation of the receiving member relative to the inverting element. Thus, the inverting element is arranged near the near side of the receiving member, and further away from the far side of the receiving member.

For example, the stop member is adapted to be retracted from the first side of the inverted sheet into the second position of the stop member. For example, in the second position of the stop member, the first side of the inverted sheet is released from the stop member. For example, the inverted sheet may rest on the stop member until the stop member is retracted into the second position, thereby allowing the sheet to roll out.

Due to the stop member limiting the movement of the sheet towards the far side of the receiving member, especially in the particular orientation of the sheet described above, the leading edge of the small panel, or "inner edge" of the folded sheet, cannot depart far from the large panel. Thus, unfolding of the sheet is at least limited, or, in particular, substantially inhibited. For example, the movement of the "inner edge" of the sheet towards a far side of the receiving member is limited until the trailing edge of the sheet is released from the inverting element. For example, the stop member may be arranged such that the trailing part of the large panel comes to lie along the small panel of the sheet.

For example, the stop member may be positionable such that the sheet comes to at least partially lie against and/or on top of the stop member, before the stop member is retracted into its second position.

Because the stop member may limit an unfolding movement of the sheet, the sheet is reliably received in its folded state by the receiving member. Thus, a folded sheet may be inverted with the folded sheet portion being at the first side of a presently inverted sheet, this side being the side facing the receiving member after inverting, and with the folded part of the sheet as the trailing part of the sheet when fed to the inverting element. In other orientations of the folded sheet, for example, the stop member may also ensure that the sheet does not unfold. When inverting plain, i.e. unfolded sheets, for example, the stop member is not needed. For example, the stop member may be maintained in its second position throughout inverting a plain sheet.

The object of the present invention is further achieved by a method of inverting a folded sheet comprising a large panel and a small panel that is folded, at a first edge side of the sheet, towards the large panel on a first side of the sheet, comprising: bending and rotating at least a second edge side leading part of the sheet around an axis of rotation, receiving the second edge of the sheet at a first end of a receiving member, limiting, by a stop member in a first position above the receiving member, an unfolding movement of the small panel of the sheet at the first side of the presently bent sheet in a direction towards a far side of the receiving member, retracting the stop member from said first position and letting the first edge side of the sheet roll out towards the far side of the receiving member, and receiving the folded sheet with a second sheet side up on the receiving member. The advantages of the method correspond to the advantages of the above described sheet inverting device. For example, the method may be performed using a sheet inverting device as described above.

Retracting of the stop member from said first position and letting the first edge side of the sheet roll out may be performed in any chronological order. For example, retracting the stop member may be performed before, after, or partially or completely concurrently with letting the first edge side of the sheet roll out. Receiving the folded sheet on the receiving member may be performed concurrently with one or more of the preceding steps. In general, the steps of the described method may be performed in any suitable order.

Letting the first edge side of the sheet roll out may comprise, for example, forcing the first edge side of the sheet to roll out towards the far side of the receiving member.

Useful details of the invention are indicated in the dependent claims.

In one embodiment, the inverting element is adapted to force the sheet to bend with the first side of the sheet outward. Thus, a compact configuration of the inverting device is achievable. For example, the sheet inverting element is a rotatably arranged element, comprising a slot at its circumferential edge for accepting at least a second edge portion of a sheet to be inverted. For example, in a first rotation zone of the rotatably arranged element, the rotatably arranged element may accept the sheet to be inverted and, in a second rotation zone, the accepted sheet is conveyed towards the receiving member. For example, at least a second edge side leading part of the sheet is bent and rotated around the axis of rotation as the sheet is conveyed.

In one embodiment, the at least one stop member is mounted to be rotatable between said first position and said second position about an axis of rotation. For example, in the first position of the stop member, the stop member is positioned below its axis of rotation. For example, the axis of rotation is above the receiving member. For example, by rotating the stop member from its first position into its second position, the stop member may be retracted from its first position in a direction towards the far side of the receiving member. The stop member being rotatably mounted has the advantage that the stop member may easily be pulled out from under a sheet that is received on the receiving member. Furthermore, the drive mechanism of a rotatable stop member may have a simple configuration.

Preferably, the sheet inverting device further comprises at least a first movable guide member, that, in a first position, extends upward above the receiving member for inhibiting entrance of the sheet towards the far side of the receiving member. For example, the first position of said guide member is a position that is above the first position of said at least one stop member. In particular, for example, in the first position of the guide member, the guide member may extend above said at least one stop member being in its first position. Thus, it may be ensured that no part of the presently inverted sheet gets towards the far side of the receiving member and/or beyond the stop member in an uncontrolled manner. Thus, the guide member may close off a sheet inverting space towards the far side of the receiving member, that is, a space defined by the movement of the sheet while been inverted. For example, the guide member may be adapted to guide the inner edge of the presently inverted sheet downward, that is, towards the receiving member.

For example, the first moveable guide member and at least one stop member of the at least one moveable stop member are moveable into respective positions, in which the first moveable guide member is retracted from its first position and said stop member is in its first position for limiting an unfolding movement of the sheet in a direction towards a far side of the receiving member. Thus, the first edge of the sheet is enabled to get ahead of the inner edge of the folded sheet. Thus, the process of rolling out of the sheet is supported.

For example, the sheet inverting device further comprises at least a second moveable guide member that, in a first position, extends upward above the receiving member for inhibiting entrance of the sheet towards the far side of the receiving member and is inclined towards the far side of the receiving member, wherein, in the first position of the at least one first moveable guide member, the at least one first moveable guide member is inclined towards the near side of the receiving member. The first guide member being inclined towards the near side of the receiving member may reliably guide the inner edge of the folded sheet downwards toward the receiving member. The second guide member being inclined towards the far side of the receiving member may enable the first edge of the sheet to get ahead of the inner edge of the folded sheet. For example, the second guide member may be retracted from the first side of the inverted sheet and the sheet may be received on the receiving member as the sheet rolls out.

Thus, the first and second guide members may facilitate inverting the sheet in a controlled manner. Furthermore, by providing two distinct guide members, the mechanism for moving each guide member may have a simple configuration while still providing different directions of inclination of a guide member as well as allowing to completely retract the guide member(s) from below the inverted sheet.

Alternatively, in the first position of the at least one first moveable guide member, the at least one first moveable guide member may be inclined towards the near side of the receiving member, and the first moveable guide member may be moveable into a second position, in which it extends upward above the receiving member for inhibiting entrance of the sheet towards the far side of the receiving member and is inclined towards the far side of the receiving member. In this case, a second guide member may be not required.

For example, said at least one second guide member may comprise said at least one stop member. For example, the stop member may form a lower part of the second guide member. For example, said at least one first guide member may comprise at least one further stop member. For example, said further stop member may form a lower part of the first guide member. For example, the first guide member may be inclined towards the near side of the receiving member, while a stop member is in a first position above the receiving member for limiting an unfolding movement of the small panel of the sheet.

In one embodiment, the at least one stop member comprises one of the first and second guide members, the sheet inverting device further comprises a driving device configured to move the at least one stop member including said one of the first and second guide members, and the other one of the first and second guide members comprises an engaging device configured to engage with said one of the first and second guide members in order to lag behind the other one of the first and second guide members in a first direction of movement of the guide members. Thus, only one driving device is necessary for moving the first and second guide members between respective receiving and/or support positions and a retracted position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
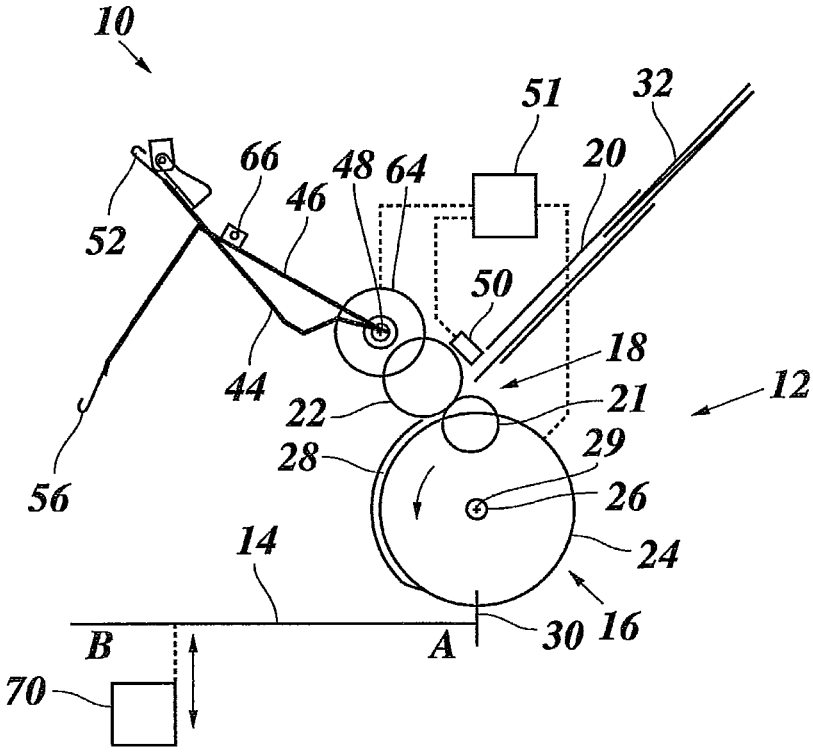
FIGS. 1-4 are diagrams of side views of a sheet inverting device according to the present invention and show the operation of the device.

The present invention will now be described with reference to the accompanying drawings, wherein the same or similar elements are identified with the same reference numeral.

FIG. 1 is a diagram showing a stacking device including a sheet inverting device 12 and a receiving member 14 in the form of a receiving plane for stacking sheets thereon. The sheet inverting device 12 includes a sheet inverting element 16 and a feeding unit 18 for feeding a sheet to the sheet inverting element 16.

For example, a conveyer path 20 is arranged so that a sheet may be supplied along the conveyer path 20 to the feeding unit 18. For example, the feeding unit 18 comprises first feeding rollers 21 and second feeding rollers 22, between which a feeding nip is formed for frictionally transporting a supplied sheet through the feeding nip.

The sheet inverting element 16 comprises rotatably arranged elements 24, which are for example formed by disks arranged on a rotation shaft 26 that is drivable by an electrical driven motor, such as an electric servo motor or a stepping motor. The rotatably arranged elements 24 comprise at least one slot 28 at their outer circumferential contour in which at least a leading part of a sheet may be accommodated. In a rotational position within a first rotation zone of the rotatably arranged elements 24 shown in FIG. 1, the opening of the slot 28 is arranged in front of the feeding unit 18, so that a feeding unit 18 may feed a sheet to the slot 28.

When a sheet is fed to the slot 28, the sheet inverting device 12 operates as follows. The leading edge of the sheet is accepted in the slot 28. As the sheet is, at least partially, fed into the slot 28, it is bent and rotated around an axis 29 of rotation of the rotation shaft 26. Then, or concurrently therewith, the rotatably arranged elements 24 are rotated as indicated by an arrow in FIG. 1, and the leading part of the sheet is further rotated around the axis 29 of rotation, until the leading edge of the sheet abuts onto a stripping element 30 arranged to interfere with the slot 28 as the slot 28 is rotated towards a lower circumferential location of the rotatably arranged elements 24. For example, the stripping element 30 is in the form of a stop protruding from below between the rotatably arranged elements 24.

Figure 5:
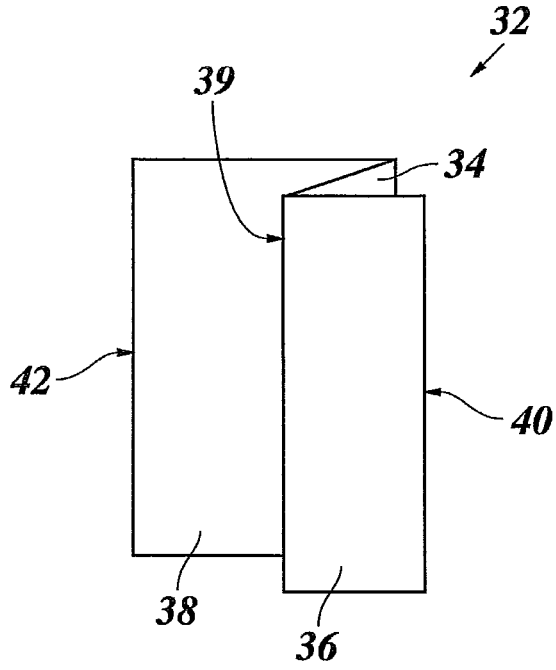
FIG. 5 is a diagram showing an example of a folded sheet.

FIG. 5 schematically shows a sheet 32 comprising an engineering fold, i.e. a z-folded sheet having a small center panel 34, a small end panel 36 and a large end panel 38. The small end panel 36 and center panel 34 have a width that approximately corresponds to half of the width of the large panel 38. FIG. 5 shows the front side of the sheet 32. The center panel 34 is folded against the front side of the large panel 38, the small panel 36 is folded at an "inner edge" 39 of the sheet against the center panel 34. The outer edge of the small panel 36 forms a first edge 40 of the sheet 32 and, at the upper side, the outer end of the large panel 38 forms a second edge 42 of the folded sheet 32, opposite from the first edge 40.

In FIGS. 1 and 5, for reasons of clarity, the sheet 32 is shown in a partly unfolded state. However, the sheet 32 may be supplied to the feeding unit 18 in a flat, folded state. The folded sheet 32 is fed through the feeding unit 18 with the second edge 42 as its leading edge and the first edge 40 as its trailing edge, and with a back side of the sheet 32 oriented towards the rotatably arranged elements 24. For example, this orientation of the sheet may be due to a prescribed orientation of printed sheets e.g. accepted from a printing device that may be coupled to the stacking device 10.

In the state shown in FIG. 1, the leading second edge 42 of the folded sheet 32 is fed by the feeding unit 18 into the slot 28. For example, approximately half of the width of the large panel 38 may be accommodated in the slot 28.

When the leading edge of the sheet abuts upon the stripping element 30, and the rotatably arranged elements 24 are rotated further and, depending on the length of the sheet 32, the sheet 32 is further fed through the feeding unit 18, the sheet 32 is forced to bulge from the circumferential contour of the rotatably arranged elements 24. As the input opening of the slot 28 passes the stripping element 30, the leading edge of the sheet 32 is released from the sheet inverting element 16 and is received on the receiving member 14. Thereby, the leading edge of the sheet 32 is aligned by the stripping element 30 at a near side A of the receiving member 14, e.g. at a first end of the receiving member 14.

According to the embodiment of FIG. 1, the sheet inverting device 12 further comprises a mechanism for facilitating inverting of the folded sheet 32 in the specific orientation as described above. In particular, the sheet inverting device 12 comprises a first rotatable arm 44 and a second rotatable arm 46 being rotatable about an axis 48 of rotation that is arranged at a height above the rotatably arranged elements 24 and at a position above the receiving member 14 and between the near side A and the far side B and of the receiving member 14.

In FIG. 1, the arms 44 and 46 are in a passive position distant from the receiving member 14 and above a sheet inverting space above the receiving member 14. A sensor 50 arranged at the feeding unit 18 detects the arrival of the leading edge 42 of the sheet at the feeding unit 18. The sensor 50 is connected to a control unit 51 that controls the movement of the arms 44, 46, as well as the movement of the sheet inverting element 16. Thus, the control unit 51 forms a synchronizing device configured to synchronize a movement of the arms 44, 46 with an inverting of a sheet performed by the inverting element 16 as described in the following. Thus, the alignment of sheets that are received consecutively on the receiving member 14 may be improved. Further, the speed and the throughput of the sheet inverting device may be enhanced.

Figure 2:
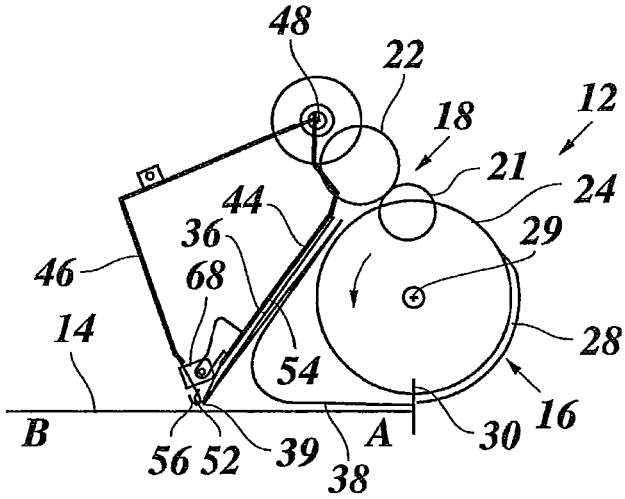

The arrival of the leading edge 42 of the sheet 32 at the sensor 50 triggers a movement of the arms 44, 46 to a first position or receiving position shown in FIG. 2.

In this position, the first arm 44 forms a first stop member 52 for the sheet 32 at the end of the arm 44, which is positioned above the receiving member 14 in a position above and near the center of the receiving member 14 between its near side A and its far side B. Further, the arm 44 forms a first guide member 54, of which the first stop member 52 is a part. The first guide member 54 extends from the first stop member 52 approximately in a straight line to a location near the feeding unit 18 and leaving a gap between the first guide member 54 and the outer contour of the rotatably arranged elements 24. In particular, the first guide member 54 extends upward above the receiving member 14 and is inclined towards the near side A of the receiving member 14.

In this position of the first arm 44, the first stop member 52 and first guide member 54 limit a space that is available for the sheet while the sheet is stripped from the sheet inverting element 16 as the leading second edge 42 of the sheet 32 abuts upon the stripping element 30 and the rotatably arranged elements 24 rotate further. When the inner edge 39 is released from the feeding unit 18 and tends to lift from the outer contour of the rotatably arranged elements 24, the first guide member 54 may guide the inner edge 39 towards the first stop member 52. Furthermore, if the inner edge 39 slides along the surface of the receiving member 14 or a previous sheet thereon, then the first stop member 52 may limit this movement towards the far side B of the receiving member.

FIG. 2 shows a state in which the sheet 32 is completely released from the slot 28 and from the feeding unit 18. The sheet inverting element 16 is in a second rotation zone, in which the slot 28 has passed the stripping element 30. The large panel 38 is in a bent configuration forming a bulge with the front side outwards. The small panel 36 does not follow the bent configuration of the large panel 38. Rather, the inner edge 39 is separated from the large panel 38. However, the stop member 52 limits a movement of the inner edge 39 towards the far side B of the receiving member 14, and the small panel 36 may be supported by the first guide member 54 from above in case that the bent large panel 38 exerts a force on the center panel 34 and small panel 36 as it tends to assume a straight configuration.

When the first arm 44 is in its receiving position shown in FIG. 2, the second arm 46 is behind the first arm 44, so that the first guide member 54 and the first stop member 52 may contact the inverted sheet 32.

Figure 3:
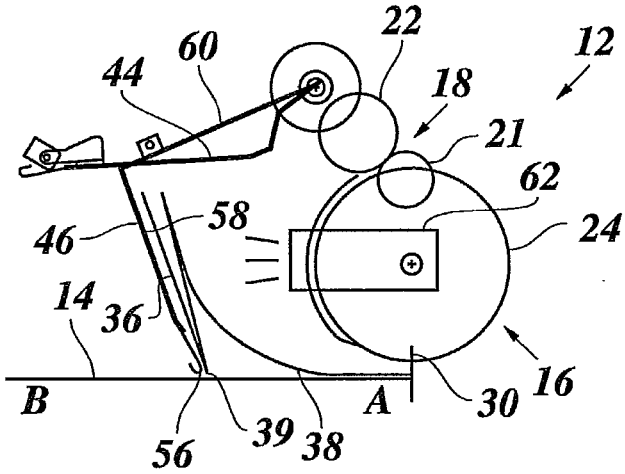

After the sheet 32 has been received in the space limited by the first guide member 54 as shown in FIG. 2, the first arm 44 moves into an intermediate position shown in FIG. 3, in which position the first guide member 54 is retracted from the front side of the sheet 32. The second arm 46 forms, for example, a second stop member 56 and a second guide member 58 for the sheet 32. For example, the second stop member 56 is positioned, in the first position or supporting position of the second arm 46 shown in FIG. 3, above the receiving member 14 at the same or a similar position as the position of the first stop member 52 in the receiving position of the first arm 44. The second guide member 58 extends upward above the receiving member 14. In particular, in this position, the second stop member 56 is a lower part of the second guide member 58.

However, different from the first guide member 54 in the receiving position of the first arm 44, the second guide member 58 is inclined towards the far side B of the receiving member 14 in the supporting position of the second arm 46. For example, the second arm 46 comprises two portions at approximately a right angle to each other, a first portion forming the second guide member 58 and second stop member 56 at the end of the arm 46, and a second portion 60 connecting the second guide member 58 to a rotation shaft at the axis 48 of rotation of the arm 46.

As the first guide member 54 is retracted, the small panel 36 and the first edge side of the sheet 32 may turn over the inner edge 39 being stopped by the second stop member 58, such that, in the situation shown in FIG. 3, the small panel 36 leans against the second guide member 58. Thus, the sheet 32 may partly roll out towards the far side B of the receiving member 14. This may be driven by the large panel 38 having the tendency to assume a straight configuration. However, especially in the case of a weak material of the sheet 32 or a in the case of a thin sheet 32, a blower or airflow generator 62 arranged above the sheet inverting space may provide an airflow against the back side of the sheet 32 in order to force the sheet 32 to roll out. By generating an airflow against the second side of the presently inverted sheet 32, rolling out of thin, weak or limp sheets may be facilitated. In particular, a sheet may be prevented from collapsing onto itself. The airflow generator 62 is, for reasons of clarity, only shown in FIG. 3.

When the sheet 32 is partly rolled out towards the far side B of the receiving member 14, such that the first edge 40 of the sheet 32 is further to the far side B of the receiving member 14 than the inner edge 39, the second arm 46 is retracted from the front side of the second panel 36.

As the second guide member 58 is retracted, the sheet 32 further rolls out and assumes a flat configuration on the receiving member 14, the large panel 38 being folded on top of the center panel 34 and small panel 36. Thus, while the second edge 42 of the folded sheet 32 is still aligned at the stripping element 30, the first edge 40 of the folded sheet 32 is received at the far side B of the receiving member 14. Thus, the folded sheet 32 has been inverted.

The first and second arms 44, 46 may then, for example, move again into the stand-by position shown in FIG. 1. In this stand-by position of the arms 44, 46, the stop members 52 and 56 as well as the first and second guide members 54 and 58 are in a second position outside the sheet inverting space.

Thus, in operation, the first arm 44 may assume, in particular, its first position or receiving position shown in FIG. 2, an intermediate position shown in FIG. 3 and a second or passive position shown in FIG. 1. The second arm 46 may assume a first position or supporting position shown in FIG. 3 and a second or passive position shown in FIG. 1.

In the present embodiment, for example, while the first arm 44 is in its receiving position shown in FIG. 2, the second arm 46 may be in the same position as in its supporting position shown in FIG. 3. For example, the first arm 44 may be driven by a driving device 64 such as a servo motor or stepper motor, which driving device is controlled by the control unit 51. For example, the second rotating arm 46 may be a passive arm that is moved along with the first arm 44 by engaging of a respective engaging device that will be described in the following.

For example, as shown in FIG. 1, the second arm 46 may comprise a first engaging device 66, such as a hook, for engaging with, e.g. a back side of the first arm 44. Thus, in the situation of FIG. 1, the engaging device 66 rests on the first arm 44, so that the second arm 46 is held in the stand-by position. When the first arm is lowered into its first position shown in FIG. 2, the second arm 46 follows the first arm 44 until it is stopped by the end of the second arm 46 reaching, e.g. a stop above or at the receiving member 14. That is, the second stop member 56 is supported by said stop in the situation of FIG. 2, and the first arm 44 is moved further into its receiving position.

When the first arm 44 is retracted into its intermediate position shown in FIG. 3, the second arm 46 still rests on the stop at the receiving member 14. When the first arm 44 is rotated further, the first engaging device 66 again engages with the first arm 44, and the second arm 46 follows the first arm 44 into the stand-by position shown in FIG. 1. Thus, the second arm 46 lags behind the movement of the first arm 44 from the first position to the second position of the first arm 44.

When the first arm 44 is moved from the position shown in FIG. 1 towards its receiving position shown in FIG. 2, a second engagement device 68 provided on the back side of the first arm 44 may engage with the back side of the second arm 66 in order to pull the second arm 46 into its first position, as is indicated in FIG. 2. Thus, it is ensured that the second arm 46 is in its supporting position when the first arm 44 is retracted again.

Figure 4:
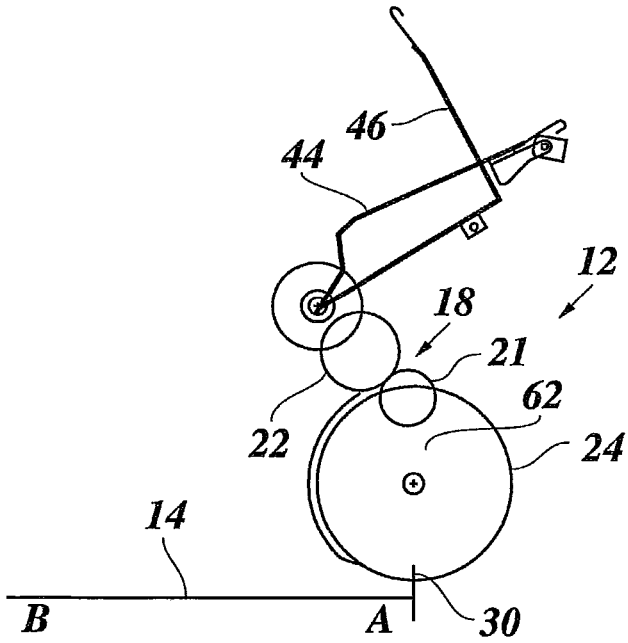

Alternatively to providing an active, driven first arm 44 and a passive second arm 46, the first and second arms 44 and 46 may each be driven by a respective driving device 64. Then, for example, the arms 44 and 46 may fold back to an out-of-use position shown in FIG. 4, when the arms are not in use.

For example, one or more sensors may be provided for detecting one of the described positions of the first arm 44 and/or second arm 46.

A suitable timing for the described steps may be determined by experiment.

A preferred embodiment of the invention being thus described it will be obvious that the same may be varied in many ways.

For example, instead of the stripping element 30 providing for alignment of the second edge 42 of the folded sheet 32 on the receiving member 14, a separate alignment device may be provided at the receiving member 14.

While each folded sheet 32 may be inverted and received on the receiving member 14 as described above, the folded sheet 32 and, optionally, plain sheets or folded sheets in different orientations may be likewise inverted and received on the receiving member 14 and may be, in particular, stacked on the receiving member 14. For example, the stacking device 10 may comprise an elevating device 70 (see FIG. 1) for raising and lowering the receiving plane of the receiving member 14. Thus, the receiving member 14 may be lowered as more and more sheets are stacked on the receiving member 14.

Figure 6:
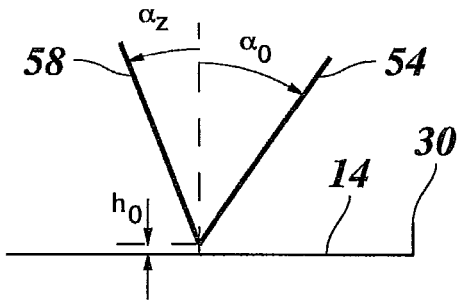
FIG. 6 is a schematic diagram of orientations of guide members.

FIG. 6 schematically shows the first guide member 54 in its receiving position above the receiving member 14, as well as the second guide member 58 in its supporting position above the receiving member 14. $\alpha_0$ denotes the inclination angle of the first guide member 54 with respect to a vertical direction and preferably is at least 10°, even more preferably at least 20°. For example, $\alpha_0$ is more than 30°. Preferably, $\alpha_0$ is less than 45°. $\alpha_z$ denotes an angle of inclination of the second guide member 58 before retracting the second guide member, with respect to a vertical direction. Preferably, $\alpha_z$ is not less than 10°, or, more preferably, not less than 20°. For example $\alpha_z$ is not more than 45°.

In FIG. 6, a minimum free height between the first and second stop members 52 and 56 and the receiving member 14 or a topmost sheet on the receiving member 14 is denoted as $h_0$. For example, $h_0$ is not less than 0 mm and not more than 20 mm. Preferably, $h_0$ is not more than 10 mm. Preferably, the arms 44 and 46 do not put a load on the receiving member 14. Alternatively, the arms 44 and/or 46 may be supported directly or, e.g. via stacked sheets, indirectly by the receiving member 14.

Figure 7:
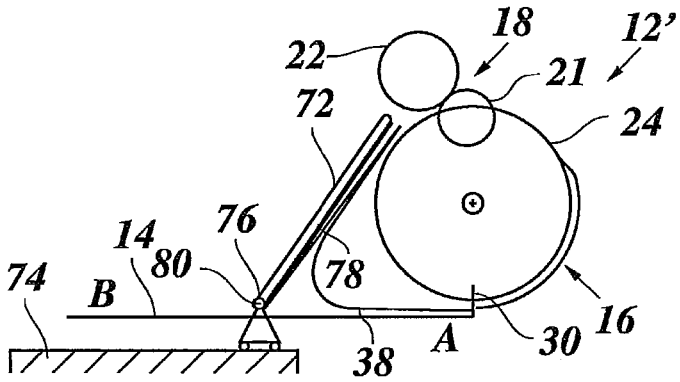
FIGS. 7-9 are diagrams of side views illustrating a configuration and operation of a second embodiment.
Figure 8:
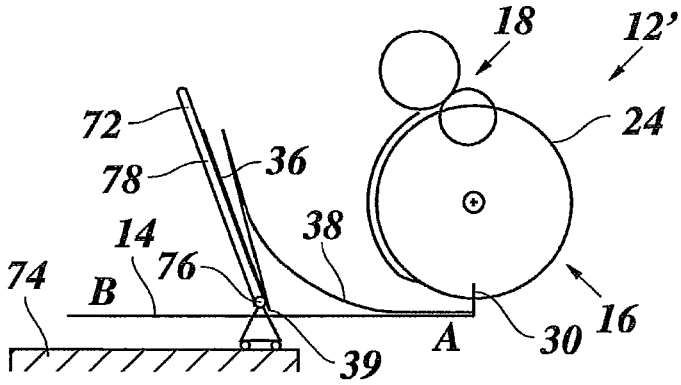
Figure 9:
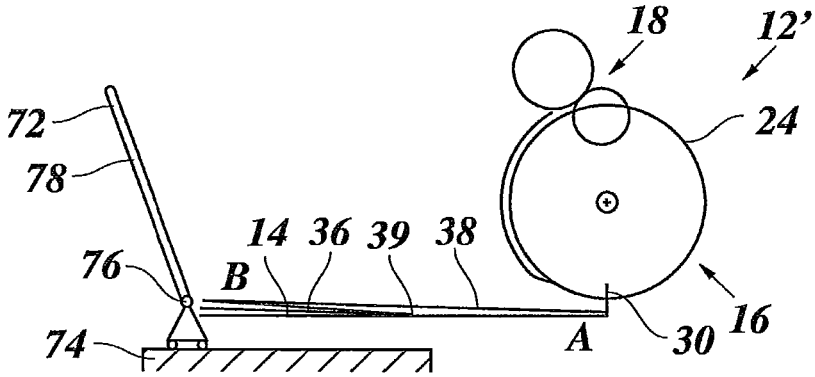

FIGS. 7 to 9 schematically illustrate a sheet inverting device 12' according to a second embodiment. The sheet inverting element 16, the feeding unit 18 and the receiving member 14 correspond to those of the first embodiment described in conjunction with FIGS. 1 to 3, and, in the following, only the differences to the first embodiment will be explained. Similar or corresponding elements are indicated with the same reference signs and are not explained again.

Instead of providing first and second rotatable arms 44, 46, in the present embodiment, the sheet inverting device 12' comprises a rotatable arm 72, rotatably mounted on a linear guide rail 74 that extends parallel to the receiving member 14.

The rotatable arm 72 forms a stop member 76 and a guide member 78 for the presently inverted sheet 32. In a first position of the arm 72 shown in FIG. 7, the stop member 76 is positioned in a position that corresponds to the position of the first stop member 52 of FIG. 2. Similar to the first guide member 54 in FIG. 2, the guide member 78 extends upward above the receiving member 14, and is inclined towards the near side A of the receiving member 14. However, whereas in the first embodiment, the first arm 44 is rotatable about an axis of rotation 48 at an end of the arm 44 opposite to the stop member 52, in the present embodiment, the arm 72 is rotatable about an axis 80 of rotation at the lower end of the arm 72, i.e. near the stop member 76. In the receiving position of the arm 72 of FIG. 7, the folded sheet 32 is received, while the sheet inverting space is limited by the guide member 78, and an unfolding movement of the small panel 36 of the sheet 32 is limited by the stop member 76.

Then, as shown in FIG. 8, the arm 72 is rotated from its receiving position of FIG. 7 into its supporting position. The supporting position of the arm 72 and guide member 78 corresponds to the supporting position of the second arm 46 shown in FIG. 3.

Afterwards, the arm 72 with the stop member 76 and guiding member 78 is retracted from below the first side of the folded sheet 32 by moving along the guide rail 74 towards and beyond the far side B of the receiving member 14, as is shown in FIG. 9. Thus, the folded sheet 32 assumes a flat state on the receiving member 14. The receiving member 14 may then, for example, be lowered, and the arm 72 may be moved into its first position shown in FIG. 7, again, in order to be ready to receive the next folded sheet.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet inverting device for inverting a folded sheet, comprising:

a receiving member for receiving the folded sheet;

an inverting element for inverting the folded sheet around an axis of rotation towards the receiving member;

at least one moveable stop member for limiting, in a first position of the at least one moveable stop member above the receiving member, an unfolding movement of the folded sheet in a direction towards a far side of the receiving member, wherein the at least one movable stop member is adapted to be retracted from the first position into a second position of the stop member; and at least a first moveable guide member that, in a first position, extends upward above the receiving member for inhibiting entrance of the folded sheet towards the far side of the receiving member, wherein the first moveable guide member and the at least one movable stop member are moveable into respective positions, in which the first moveable guide member is retracted from the first position thereof and said at least one movable stop member is in the first position thereof for limiting an unfolding movement of the folded sheet in a direction towards a far side of the receiving member.

2. The sheet inverting device as claimed in claim 1, the sheet inverting device being a sheet inverting device for inverting a folded sheet comprising a large panel and a small panel that is folded, at a first edge side of the folded sheet, against the large panel on a first side of the sheet, the sheet inverting device comprising:

said receiving member for receiving the folded sheet with a second sheet side up;

said inverting element for inverting the folded sheet around an axis of rotation onto the receiving member in a direction such that a second edge of the folded sheet is received at a near side of the receiving member; and said at least one moveable stop member for limiting, in a first position of the at least one movable stop member above the receiving member, an unfolding movement of the small panel of the folded sheet at the first side of the presently inverted folded sheet in a direction towards a far side of the receiving member, wherein the stop member is adapted to be retracted from the first side of the inverted folded sheet into a second position of the stop member.

3. The sheet inverting device as claimed in claim 2, wherein the inverting element is adapted to force the folded sheet to bend with the first side thereof outward.

4. The sheet inverting device as claimed in claim 1, further comprising a synchronizing device configured to synchronize a movement of the at least one movable stop member with an inverting of a folded sheet performed by the inverting element.

5. The sheet inverting device according to claim 1, further comprising an air flow generator configured to generate an air flow against a side of the presently inverted folded sheet.

6. The sheet inverting device according to claim 1, further comprising a stripping element configured to strip the folded sheet from the inverting element by catching an edge of the sheet.

7. The sheet inverting device according to claim 1, wherein the at least one movable stop member is mounted to be rotatable between said first position and said second position about an axis of rotation.

8. The sheet inverting device according to claim 1, further comprising at least a second moveable guide member that, in a first position, extends upward above the receiving member for inhibiting entrance of the folded sheet towards the far side of the receiving member and is inclined towards the far side of the receiving member, wherein, in the first position of the at least one first moveable guide member, the at least one first moveable guide member is inclined towards the near side of the receiving member.

9. A method of inverting a folded sheet comprising a large panel and a small panel that is folded, at a first edge side of the folded sheet, towards the large panel on a first side of the folded sheet, said method comprising the steps of:

bending and rotating at least a second edge side leading part of the folded sheet around an axis of rotation;

receiving the second edge of the folded sheet at a first end of a receiving member, limiting, by at least one movable stop member in a first position above the receiving member, an unfolding movement of the small panel of the folded sheet at the first side of the presently bent folded sheet in a direction towards a far side of the receiving member;

retracting the at least one movable stop member from said first position and letting the first edge side of the sheet roll out towards the far side of the receiving member, and receiving the folded sheet with a second sheet side up on the receiving member.

10. The method as claimed in claim 9, further comprising the steps of:

guiding, while the at least one movable stop member is in the first position thereof, the small panel of the folded sheet along a guide member that extends towards the at least one movable stop member; and retracting said guide member towards the far side of the receiving member while the at least one movable stop member is in the first position thereof and limits an unfolding movement of a lower edge of the small panel at the first side of the folded sheet in said direction towards the far side of the receiving member.

* * * * *